United States Patent [19]

Watabe et al.

[11] Patent Number: 4,534,410

[45] Date of Patent: Aug. 13, 1985

[54] AIR COOLING TYPE HEAT EXCHANGER FOR A REFRIGERATING APPARATUS ACCOMMODATED IN A CONTAINER

[75] Inventors: Shin Watabe; Hideto Shibata, both of Nagoya, Japan

[73] Assignees: Mitsubishi Jukogyo Kabushiki; Churyo Engineering Co., Ltd., both of Japan

[21] Appl. No.: 498,698

[22] Filed: May 27, 1983

[30] Foreign Application Priority Data

Jul. 12, 1982 [JP] Japan ..... 57-104333[U]

[51] Int. Cl.[3] ..... F24B 1/06; F28F 13/12

[52] U.S. Cl. ..... 165/126; 165/55; 165/63; 165/129

[58] Field of Search ..... 165/47, 48 R, 53, 55, 165/58, 63, 122, 124, 126, 129

[56] References Cited

U.S. PATENT DOCUMENTS

| | | | |
|---|---|---|---|
| 3,135,102 | 6/1964 | Ullstrand | 165/129 |
| 3,831,670 | 8/1974 | Mullings | 165/124 |
| 3,844,344 | 10/1974 | Kliemann et al. | 165/129 |
| 3,939,906 | 2/1976 | Rothenbucher | 165/124 |
| 3,942,588 | 3/1976 | Schoonman | 165/129 |
| 4,227,068 | 10/1980 | Carter | 165/129 |

FOREIGN PATENT DOCUMENTS

| | | | |
|---|---|---|---|
| 2042151 | 9/1980 | United Kingdom | 165/129 |

*Primary Examiner*—Henry C. Yuen
*Assistant Examiner*—Steven E. Warner
*Attorney, Agent, or Firm*—McGlew and Tuttle

[57] ABSTRACT

An improved air cooling type heat exchanger for a refrigerating apparatus accommodated in a container is disclosed, wherein the improvement consists in that the air cooling type heat exchanger is divided into a plurality of segments which are arranged in a stepped relation in the direction of main air flow in such a manner that they overlap with a certain distance kept between the adjacent ones. Thus, it is assured that the heat exchanger is designed and constructed in smaller dimensions and moreover it is operated at a high efficiency.

5 Claims, 4 Drawing Figures

AIR COOLING TYPE HEAT EXCHANGER FOR A REFRIGERATING APPARATUS ACCOMMODATED IN A CONTAINER

FIELD AND BACKGROUND OF THE INVENTION

The present invention relates to an air cooling type heat exchanger for a refrigerating apparatus accommodated in a container.

As is well known, a conventional refrigerating apparatus to be accommodated or incorporated in a container is subjected to strictly limitative requirements particularly with respect to mounting space, because outside dimensions of the container are limitatively determined within predetermined limits and moreover the container has another requirement for carrying cargos or articles as much as possible while containing them therein. On the other hand, due to the fact that this type of refrigerating apparatus is generally secured to one side wall of a container it is naturally subjected to dimensional limitations with respect to its height and width, depending on outside dimensions of the container. Accordingly, designing of the refrigerating apparatus in reduced thickness means that the whole apparatus is designed and constructed in smaller dimensions.

Since an air cooling type heat exchanger is combined with a motor driven fan under the above-mentioned dimensional limitations, it is necessary that the heat exchanger has an effective working surface which is as wide as possible while a sufficiently wide area of heat conduction is assured for it in conjunction with a properly determined blowing capacity of the fan.

However, to facilitate manufacturing of the conventional air cooling type heat exchanger (air cooling type condenser) as identified with reference numeral 1 in FIG. 1, it is generally designed in the cross-sectional configuration as schematically illustrated in the drawing. It goes without saying that the dimension of the air cooling type heat exchanger as measured in the direction of thickness of the refrigerating apparatus is defined by the allowable maximum dimension.

In the drawing reference numeral 2 designates a heat insulating wall, reference numeral 3 designates a fan motor, reference numeral 4 an orifice and reference numeral 5 an air flow shielding plate. As is apparent from the drawing, the thickness of the refrigerating apparatus is usually represented by summation of the thickness of the heat insulating wall 2, the dimension of the air cooling type heat exchanger 1 as seen in the direction of thickness and the thickness of the air flow shielding plate 5 plus dimensions of tightening bolts or the like.

However, it is found that designing and constructing of a refrigerating apparatus in reduced thickness can be achieved only within a certain limitative extent, as far as the conventional air cooling type heat exchanger of the above-mentioned type is employed and therefore the latter inhibits the provision of refrigerating apparatus having a reduced thickness.

To eliminate the foregoing problem there has been hitherto proposed an arrangement of an air cooling type heat exchanger 1 in the inclined posture as schematically illustrated in FIG. 2. In practice, it is possible to reduce thickness of the refrigerating apparatus but reduction of volume of the whole air cooling type condenser inclusive a fan motor 3 is difficult to be achieved.

Accordingly, there is left only a small space for mounting other machines such as a compressor or the like.

Incidentally, in FIG. 2 reference numeral 2 designates a heat insulating wall, reference numeral 4 an orifice and reference numeral 5 an air flow shielding plate in the same way as in FIG. 1.

SUMMARY OF THE INVENTION

Thus, the present invention has been made with the above-mentioned problem with respect to the conventional air cooling type heat exchanger in mind and its object resides in providing an improved air cooling type heat exchanger for a refrigerating apparatus accommodated in a container, which is designed and constructed in smaller dimensions and can be operated at a high efficiency.

The present invention consists in that an air cooling type heat exchanger for a refrigerating apparatus accommodated or incorporated in a container is divided into a plurality of segments which are arranged in a stepped relation in the direction of main air flow in such a manner that they overlap with a certain distance kept between the adjacent segments, whereby designing and constructing the air cooling type heat exchanger in reduced thickness and operation of the same at a high efficiency can be achieved satisfactorily.

BRIEF DESCRIPTION OF THE DRAWINGS

The accompanying drawings will be briefly described below.

DESCRIPTION OF THE PREFERRED EMBODIMENTS

Now, the present invention will be described in greater detail hereunder with reference to FIGS. 3 and 4 which illustrate two preferred embodiments of the invention.

Figure 3:
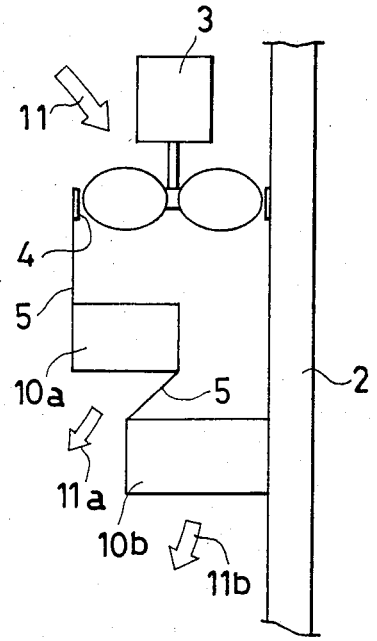
FIG. 3 is a schematic illustration of an air cooling type heat exchanger in accordance with the first embodiment of the present invention.

First, in FIG. 3 which schematically illustrates an air cooling type heat exchanger in accordance with the first embodiment of the invention, reference numerals 10*a* and 10*b* designate a first air cooling type condenser and a second air cooling type condenser constituting two essential components of an air cooling type heat exchanger of the invention. As is apparent from the drawing, both the first and second air cooling type condensers 10*a* and 10*b* are arranged one above another in a spaced relation in the direction of air flow 11 in such a manner that they overlap partially and the former is located above the latter.

Figure 1:
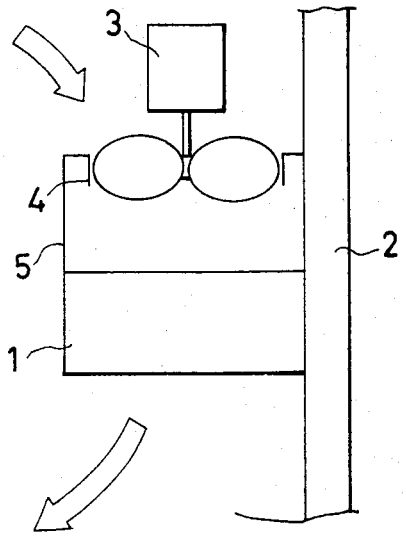
FIG. 1 PRIOR ART
FIG. 1 is a schematic illustration of a conventional air cooling type heat exchanger.
Figure 2:
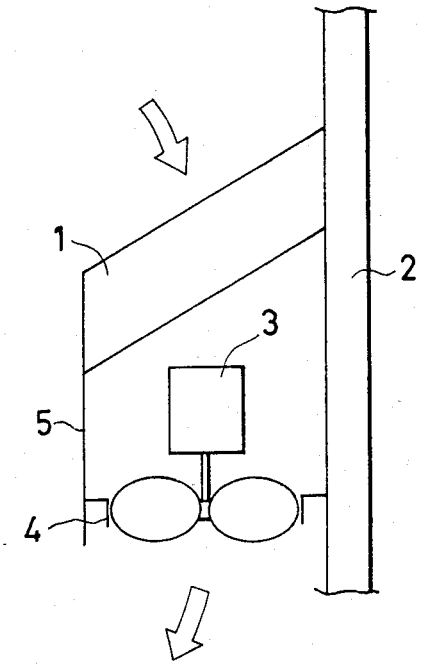
FIG. 2 PRIOR ART
FIG. 2 is a schematic illustration of another conventional air cooling type heat exchanger.

Further, in FIG. 3 reference numeral 2 designates a heat insulating wall, reference numeral 3 designates a fan motor, reference numeral 4 an orifice and reference numeral 5 an air flow shielding plate in the same way as those in FIGS. 1 and 2.

Next, operation of the air cooling type heat exchanger in accordance with the first embodiment of the invention will be described below.

Refrigerant gas discharged from a compressor flows first into the first air cooling type condenser 10*a* in which a part of superheated thermal energy and condensing latent heat of refrigerant is radiated into the air and then it flows into the second air cooling type condenser 10*b* in which residual heat of refrigerant is radiated into the air until condensing is completed.

On the other hand, air flow 11 generated by means of the fan motor 3 is stored in the space as defined by both the air flow shielding plate 5 and the heat insulating wall 2 and thereafter a part 11*a* of the air flow 11 passes through the first air cooling type condenser 10*a*. Then, a residual part 11*b* of the air flow 11 passes through the second air cooling type condenser 10*b*.

Owing to the divided structure of the air cooling type condenser into two segments 10*a* and 10*b* arranged in the above-described manner it becomes possible to reduce the net thickness of the air cooling type condenser of the invention to a considerable extent, compared with the conventional one as illustrated in FIG. 1, because it amounts to dimensional summation of the thickness of the first air cooling type condenser 10*a* and that of the second air cooling type condenser 10*b* with the overlapped dimension subtracted therefrom.

Further, it becomes possible to reduce the net height of the air cooling type condenser of the invention, i.e., the net space required for mounting the same, compared with the conventional one as illustrated in FIG. 2 which has the same area of effective working surface as that in FIG. 3 but in which the air cooling type condenser is mounted in the inclined posture.

In addition to the inventive effect of substantial reduction of mounting space another characterizing feature of the invention consists in that heat radiation is effected in two separate segments comprising the first air cooling type condenser 10*a* and the second air cooling type condenser 10*b* which are connected in series so that superheated part of refrigerant heat is radiated from the former and residual heat is radiated from the latter. As a result it becomes possible to design and construct the first air cooling type condenser 10*a* in smaller dimensions which serves to radiate superheated part of refrigerant heat, whereas it becomes possible to design and construct the second air cooling type condenser 10*b* such that the latter carries out cooling without any thermal effect from the superheated segment.

Figure 4:
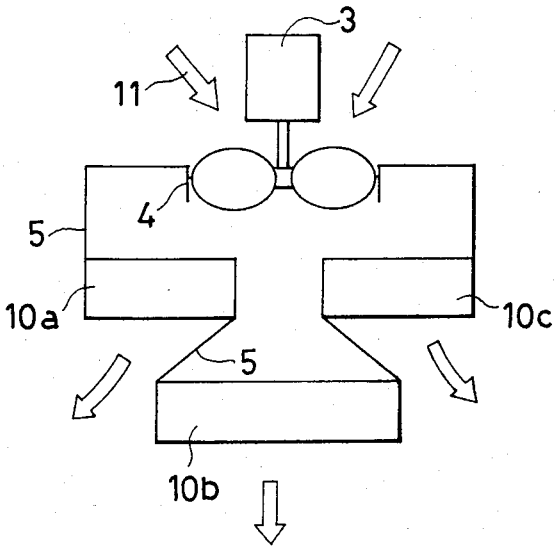
FIG. 4 is a schematic illustration of an air cooling type heat exchanger in accordance with the second embodiment of the present invention.

Next, FIG. 4 schematically illustrates an air cooling type condenser in accordance with another embodiment of the present invention. In FIG. 3 an air cooling type condenser divided into two segments in the direction of unit height is exemplified, whereas in FIG. 4 an air cooling type condenser divided into three segments in the direction of unit width is exemplified. Reference numerals 10*a*, 10*b* and 10*c* designate a segment constituting the air cooling type condenser respectively. Reference numeral 3 designates a fan motor, reference numeral 4 does an orifice, reference numeral 5 does an air flow shielding plate and reference numeral 11 does an air flow in the same way as in the foregoing embodiment.

As will be readily apparent from the drawing, it is also possible to assure that an air cooling type heat exchanger is designed in smaller dimensions and it is operated at a high efficiency.

It should be of course understood that the present invention should not be limited only to the embodiments as illustrated in FIGS. 3 and 4 but it may be changed or modified in various manners without any departure from the spirit and scope of the invention. For instance, the air cooling type condenser as illustrated in FIGS. 3 and 4 may be divided into more than three segments and they may be arranged in parallel but not in series. As a result more reduction of mounting space is achieved. Alternatively, other device such as water cooling type condenser may be disposed at each of junctions where a plurality of segments constituting an air cooling type condenser are connected to one another in series. Alternatively, a gas-liquid separator or the like device may be disposed in parallel to any one of plural segments which are arranged in series. Further, it should be noted that the present invention is applied not only to a condenser but also it may be applied to an evaporator.

We claim:

1. A refrigerating apparatus comprising:

a container defining a space and including at least one wall;

a fan for blowing cooling air in an air flow direction in the container space; and an air cooling type heat exchanger disposed in the container space downstream of said fan in the air flow direction, said heat exchanger comprising a plurality of segments which are arranged in stepped relationship, said plurality of segments including at least one upstream segment and at least one downstream segment adjacent to said upstream segment and downstream of said upstream segment with respect to said air flow direction, said upstream segment partly overlapping said downstream segment in a direction transverse to said air flow direction and being spaced from said downstream segment in said air flow direction, including a flow shielding plate connected between said upstream segment and said downstream segment and extending in an inclined position with respect to said air flow direction whereby air blown by said fan in said air flow direction is selectively divided by said flow shielding plate into at least two discrete streams, the first of said streams flows through said upstream segment and the second of said streams flows through said downstream segment.

2. A refrigerating apparatus according to claim 1, wherein said air cooling heat exchanger comprises a condensor for receiving refrigerant, said upstream segment being connected in series with said downstream segment and said upstream segment positioned to first receive refrigerant which is then passed to said downstream segment.

3. A refrigerating apparatus according to claim 2, wherein each of said plurality of segments extend perpendicularly to said air flow direction and is structured for passing air in said air flow direction.

4. A refrigerating apparatus according to claim 1, wherein one additional one of said plurality of segments is positioned at a transverse location of said upstream segment in said air flow direction, said additional segment partly overlapping said downstream segment in said transverse direction and being spaced from said downstream segment in said air flow direction.

5. A refrigerating apparatus according to claim 4, including a second air flow shielding plate connected between said additional segment and said downstream segment, on a side of said downstream segment in said transverse direction opposite from said first mentioned shielding plate, said second air flow shielding plate being inclined with respect to said air flow direction and being inclined at an angle opposite to that of said first mentioned shielding plate with respect to said air flow direction.

* * * * *